United States Patent [19]

Bynum et al.

[11] Patent Number: 4,460,865

[45] Date of Patent: Jul. 17, 1984

[54] VARIABLE TEMPERATURE COEFFICIENT LEVEL SHIFTING CIRCUIT AND METHOD

[75] Inventors: Byron G. Bynum, Tempe; Randall C. Gray, Scottsdale; Robert B. Jarrett, Tempe, all of Ariz.

[73] Assignee: Motorola, Inc., Schaumburg, Ill.

[21] Appl. No.: 412,691

[22] Filed: Aug. 30, 1982

Related U.S. Application Data

[63] Continuation-in-part of Ser. No. 236,091, Feb. 20, 1981, abandoned.

[51] Int. Cl.[3] ..... G05F 3/08

[52] U.S. Cl. ..... 323/313; 307/475; 323/907

[58] Field of Search ..... 323/312-314, 323/907, 315; 307/475

[56] References Cited

U.S. PATENT DOCUMENTS

| | | | |
|---|---|---|---|
| Re. 30,586 | 4/1981 | Brokaw | 323/314 |
| 3,781,648 | 12/1973 | Owens | 323/907 |
| 4,079,308 | 3/1978 | Brown | 323/314 |
| 4,287,439 | 9/1981 | Leuschner | 323/314 |
| 4,325,017 | 4/1982 | Schade | 323/907 |
| 4,325,018 | 4/1982 | Schade | 323/313 |

FOREIGN PATENT DOCUMENTS

| | | | |
|---|---|---|---|
| 55-74615 | 6/1980 | Japan | 323/313 |

*Primary Examiner*—William H. Beha, Jr.
*Attorney, Agent, or Firm*—Vincent B. Ingrassia

[57] ABSTRACT

A variable temperature coefficient level shifter includes a circuit which generates a voltage $V_{BE}$ having a negative temperature coefficient and a voltage $\Delta V_{BE}$ having a positive temperature coefficient. A control current is generated by placing a first resistor between $V_{BE}$ and ground and a second resistor between $\Delta V_{BE}$ and ground. Each of these currents forms a component of the control current which then has some net temperature coefficient. By properly scaling the resistors the control current may have any desired temperature coefficient between 2800 ppm and 3000 ppm. Once the temperature coefficient is set, a third resistor is provided through which the control current flows. The amplitude of the shift is then selected by selecting the value of resistor $R_S$.

9 Claims, 2 Drawing Figures

VARIABLE TEMPERATURE COEFFICIENT LEVEL SHIFTING CIRCUIT AND METHOD

CROSS REFERENCE TO RELATED APPLICATION

This is a continuation-in-part of U.S. patent application Ser. No. 236,091 filed Feb. 20, 1981, now abandoned, and asigned to the assignee of the present invention.

BACKGROUND OF THE INVENTION

1. Field of the Invention

This invention relates generally to a voltage level shifter and, more particularly, to a circuit for generating a voltage having an independently controllable temperature coefficient and amplitude.

2. Description of the Prior Art

The need often arises to provide an output current or voltage having a zero temperature coefficient, and circuits for accomplishing this are well-known. For example, reference is made to U.S. Pat. Nos. 3,887,863 entitled "Solid-State Regulated Voltage Supply", 3,617,859 entitled "Electrical Regulator Apparatus Including A Zero Temperature Coefficient Voltage Reference Circuit", and 3,893,018 entitled "Compensated Electronic Voltage Source". Such circuits generally offset the negative temperature coefficient of a base-to-emitter voltage ($V_{BE}$) of one transistor with a positive temperature coefficient derived from the base-to-emitter voltage differential ($\Delta V_{BE}$) between a pair of transistors. One of the problems associated with this prior art technique is that the amount of negative temperature coefficient that may be introduced into the output is severely restricted by a single $V_{BE}$.

SUMMARY OF THE INVENTION

It is an object of the present invention to provide a voltage level shifting circuit having a controllable temperature coefficient and which produces a stable independently controllable level shifting voltage amplitude.

It is a further object of the present invention to provide a voltage level shifting circuit having a controllable temperature coefficient and an independently controllable shift amplitude which is not affected by circuitry coupled to its output or otherwise associated therewith.

It is still further object of the invention to provide a voltage level shifting circuit having a controllable temperature coefficient and an independently controllable shift amplitude which does not require multiplying or the use of resistive voltage dividers.

According to a first aspect of the invention there is provided a level shifting circuit for producing an output voltage having a desired amplitude and temperature coefficient, comprising: a first supply voltage terminal; a second supply voltage terminal; a first current source coupled to said first supply voltage terminal for generating a first current having a positive temperature coefficient; a second current source coupled to said first supply voltage terminal for generating a second current having a negative temperature coefficient; and first resistive means coupled between said first and second current sources and said second supply voltage terminal for combining said first and second currents to produce a third current having a net temperature coefficient corresponding to said desired temperature coefficient and for generating from said third current a voltage having said net temperature coefficient, said voltage having said desired amplitude.

According to a further aspect of the invention there is provided a method for level shifting a voltage, the amplitude of the level shift and the temperature coefficient thereof being independently controllable, comprising: generating a first current having a positive temperature coefficient; generating a second current having a negative temperature coefficient; varying the magnitude of said first and second currents to achieve a net negative, zero, or positive temperature coefficient; and applying the sum of said first and second currents to a first resistive means the resistance of which being chosen to produce a required level shift.

BRIEF DESCRIPTION OF THE DRAWINGS

The above and other objects, features and advantages of the present invention will be more clearly understood from the following detailed description taken in conjunction with the accompanying drawing in which.

DESCRIPTION OF THE PREFERRED EMBODIMENT

Figure 1:
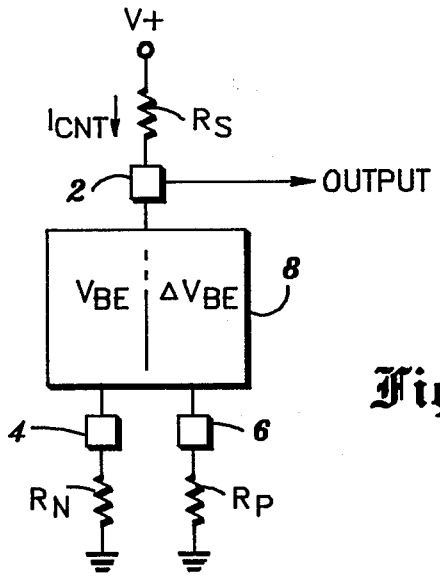
FIG. 1 is a diagram, partially in block form and partially in schematic form, illustrating the invention.

The inventive arrangement shown in the FIG. 1 includes first and second resistors $R_N$ and $R_P$ coupled between ground and nodes 4 and 6 respectively. A third resistor $R_S$ is coupled to a source of supply voltage (V+) and to node 2 from which the circuit output is taken. Block 8 which is coupled to nodes 2, 4, and 6 as shown includes circuitry for generating a first voltage $V_{BE}$ and a second voltage $\Delta V_{BE}$, $V_{BE}$ corresponding to the base-emitter voltage of a transistor and having a negative temperature coefficient, and $\Delta V_{BE}$ being the base-to-emitter voltage differential between a pair of transistor and having a positive temperature coefficient. Circuits for generating these voltages are well-known and one example will be later described in conjunction with FIG. 2.

With $V_{BE}$ appearing at node 4, the current flowing through $R_N$ has a negative temperature coefficient and a value of $V_{BE}/R_N$. In like manner, with $\Delta V_{BE}$ appearing at node 6, the current flowing through $R_P$ has a positive temperature coefficient associated therewith and a value of $\Delta V_{BE}/R_P$. Thus, the total current flowing through resistor $R_S$ ($I_{CNT}$ equals $V_{BE}/R_N$ plus $\Delta V_{BE}/R_P$). This current has a net temperature coefficient associated with it which is controlled by properly selecting resistors $R_N$ and $R_P$. For example, if $R_N$ is open (infinite impedance), the temperature coefficient of $I_{CNT}$ is totally due to the $\Delta V_{BE}$ component and is therefore positive. If, on the other hand, $R_P$ is open, the temperature coefficient of $I_{CNT}$ is due to the $V_{BE}$ term and is therefore negative. Thus, by properly scaling $R_N$ and $R_P$, the temperature coefficient of $I_{CNT}$ may be varied from approximately −2800 parts-per-million to +3000 parts-per-million.

Now that the temperature coefficient has been set to some desired value, the magnitude of the level shift appearing at node 2 can be set to some desired magnitude by properly selecting resistor $R_S$. The voltage drop across $R_S$ will now have the same temperature coefficient associated therewith as was imparted to the control current $I_{CNT}$. Thus, a voltage source has been created which has a controllable temperature coefficient and an independently controlled magnitude. That is, temperature coefficient is controlled by selecting $R_N$ and $R_P$, and the magnitude of the shift is controlled by selecting $R_S$.

Figure 2:
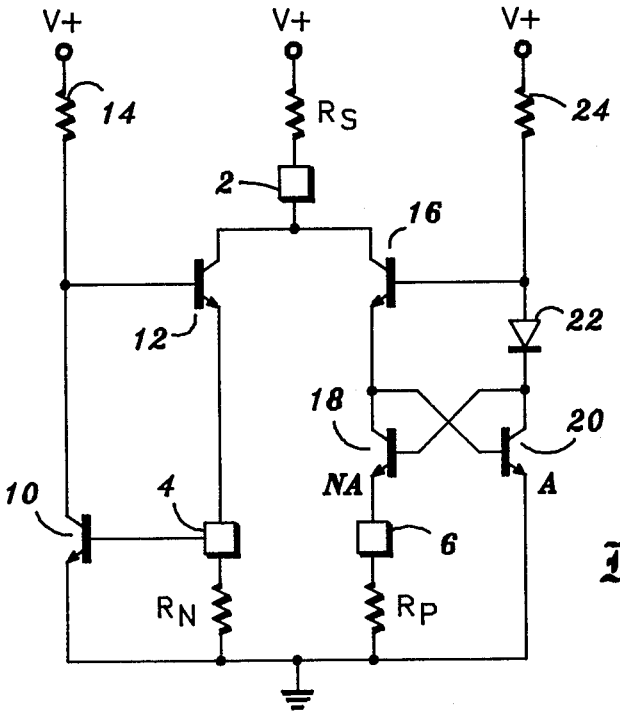
FIG. 2 is a schematic diagram of one example of a circuit for generating the voltages used in the circuit of FIG. 1.

Several advantages of the arrangement shown in the drawing should be noted. First, it is only the ratio of the resistors which sets the amplitude of the level shift and not the absolute values of the resistors. This reduces resistor tolerance requirements as long as the resistors are created using common resistor processing. For example, FIG. 2 illustrates one example of a circuit for generating a voltage $V_{BE}$ at node 4 and a $\Delta V_{BE}$ at node 6. The elements appearing in FIG. 2 which also appear in FIG. 1 have been denoted with like reference numerals. Voltage $V_{BE}$ is produced at node 4 by means of transistors 10 and 12 and resistor 14. As can be seen, the base of transistor 10 and the emitter of transistor 12 are coupled to node 4. Transistor 10 has an emitter coupled to ground and a collector coupled to the base of transistor 12 and, via resistor 14, to V+. The collector of transistor 12 is coupled to node 2. Drive current is supplied via resistor 14 to the base of transistor 12 turning it on. This in turn supplies base drive to transistor 10 turning it on. As can be seen, a voltage $V_{BE}$ appears at node 4 where $V_{BE}$ is the base-emitter voltage of transistor 10.

The voltage $\Delta V_{BE}$ is produced at node 6 by means of transistors 16, 18 and 20, diode 22, and resistor 24. The collector of transistor 16 is coupled to node 2 while its emitter is coupled to the collector of transistor 18 and to the base of transistor 20. The base of transistor 16 is coupled to tbe anode of diode 22 and, via resistor 24, to V+. The cathode of diode 22 is coupled to the collector of transistor 20 and to the base of transistor 18. The emitter of transistor 18 is coupled to node 6, and the emitter of transistor 20 is coupled to ground. As can be seen from the drawing, transistor 20 has an emitter area A and transistor 18 has an emitter area NA where N is a positive number greater than 1. Under ideal conditions, the voltages appearing at the collectors of transistors 18 and 20 will be equal. Therefore, since transistor 20 has a smaller emitter area that that of transistor 18, its current density will be greater and therefore the voltage drop across its base-emitter ($V_{BE}$) will be higher than that of transistor 18. The $\Delta V_{BE}$ which is different between the base-emitter voltages of transistors 18 and 20 appears at node 6 and will be dropped across resistor $R_P$.

It should be clearly understood that the circuit shown in FIG. 2 is only one example of a circuit for producing the required $V_{BE}$ and $\Delta V_{BE}$ at nodes 4 and 6. Many alternatives will be obvious to the skilled practitioner. if the values of $R_N$ and $R_P$ are high, the current will be low. However, since the value of $R_S$ will also be high, the resulting level shift remains the same. Second, the level shift voltage across resistor $R_S$ is constant regardless of fluctuations in the supply voltage V+.

The above description is given by way of example only. Changes in form and details may be made by one skilled in the art without departing from the scope of the invention.

We claim:

1. A level shifting circuit for producing an output voltage having a desired amplitude and temperature coefficient, comprising:

a first supply voltage terminal;

a second supply voltage terminal;

a first current source coupled to said first supply voltage terminal for generating a first current having a positive temperature coefficient;

a second current source coupled to said first supply voltage terminal for generating a second current having a negative temperature coefficient; and first resistive means coupled between said first and second current sources and said second supply voltage terminal for combining said first and second currents to produce a third current having a net temperature coefficient corresponding to said desired temperature coefficient and for generating from said third current a voltage having said net temperature coefficient, said voltage having said desired amplitude.

2. A circuit according to claim 1 wherein said first current source comprises:

first means for generating a first voltage having a positive temperature coefficient; and second resistive means coupled between said first means and said first supply voltage terminal.

3. A circuit according to claim 2 wherein said second current source comprises:

second means for generating a voltage having a negative temperature coefficient; and third resistive means coupled between said second means and said first supply voltage terminal.

4. A circuit according to claim 3 wherein said second current corresponds to the base emitter voltage of a transistor and wherein said first current corresponds to the base-emitter voltage differential of a pair of transistors.

5. A level shifting circuit for coupling to a first source of a first voltage having a positive temperature coefficient and to a second source of a second voltage having a negative temperature coefficient for the purpose of producing a voltage having a desired temperature coefficient and amplitude, comprising:

a first supply voltage terminal;

a second supply voltage terminal;

first resistive means coupled between said first supply voltage terminal and said first source for generating a first current having a positive temperature coefficient;

second resistive means coupled between said first supply voltage terminal and said second source for generating a second current having a negative temperature coefficient; and third resistive means coupled between said second supply voltage terminal and said first and second sources for combining said first and second currents to produce a third current having a net temperature coefficient and for generating therefrom a voltage having a desired amplitude and temperature coefficient.

6. A method for providing controllable voltage level shift having an independently controllable temperature coefficient, comprising:

generating a first voltage having a positive temperature coefficient;

generating a second voltage having a negative temperature coefficient;

applying said first and second voltages across first and second resistive means the values of which are chosen to result in a current having a desired net temperature coefficient; and applying said total current to a third resistive means the resistance of which determines said voltage level shift.

7. A method according to claim 6 further including:

varying said first and second resistive means to varying said net temperature coefficient; and varying said third resistive means to alter said level shift.

8. A method according to claim 7 wherein said net temperature coefficient may be varied from approximately −2800 parts per million to approximately +3000 parts per million.

9. A method for level shifting a voltage, the amplitude of the level shift and the temperature coefficient thereof being independently controllable, comprising:

generating a first current having a positive temperature coefficient;

generating a second current having a negative temperature coefficient;

varying the magnitude of said first and second currents to achieve a net negative, zero, or positive temperature coefficient; and applying the sum of said first and second currents to a first resistive means and resistance of which being chosen to produce a required level shift.

* * * * *